US005779165A

United States Patent [19]

Kim

[11] Patent Number: 5,779,165

[45] Date of Patent: Jul. 14, 1998

[54] GARBAGE DECOMPOSING APPARATUS WITH WATER REMOVAL AND FORCED-AIR HEATING SYSTEMS

[75] Inventor: Jin Surk Kim, Suwon, Rep. of Korea

[73] Assignee: Samsung Electronics Co., Ltd., Suwon, Rep. of Korea

[21] Appl. No.: 722,844

[22] Filed: Sep. 26, 1996

[30] Foreign Application Priority Data

Oct. 5, 1995 [KR] Rep. of Korea ..... 1995-34089
Apr. 9, 1996 [KR] Rep. of Korea ..... 1996-10667

[51] Int. Cl.[6] ..... B02C 23/26

[52] U.S. Cl. ..... 241/33; 241/46.016; 241/57; 241/65

[58] Field of Search ..... 366/102; 241/57, 241/199.12, 172, 65, 66, 67, 24.11, 101.2, 46.016, 46.013, 33

[56] References Cited

U.S. PATENT DOCUMENTS 5,127,587 7/1992 Johnson ..... 241/46.016
5,197,680 3/1993 Chauveau ..... 241/57
5,346,146 9/1994 Nitta ..... 241/57

*Primary Examiner*—Mark Rosenbaum
*Attorney, Agent, or Firm*—Burns, Doane, Swecker & Mathis, L.L.P.

[57] ABSTRACT

A garbage decomposing mechanism includes a vessel having an inlet channel into which garbage is deposited, and a rotary stirrer for stirring the garbage within the vessel. Deposited garbage falls upon a vertically movable member which is initially at an upper position in the inlet channel to enable water in the garbage to gravitate down a water discharge channel. When the weight of garbage on the member exceeds a predetermined value, the member is automatically lowered to bring the garbage into alignment with a garbage in infeed channel to enable to garbage to gravitate to the stirrer. The stirrer comprises a spiral wing which is hollow and has air discharge holes. Heated air is forced through the wing and out the discharge holes to heat the garbage being stirred.

10 Claims, 2 Drawing Sheets

GARBAGE DECOMPOSING APPARATUS WITH WATER REMOVAL AND FORCED-AIR HEATING SYSTEMS

BACKGROUND OF THE INVENTION

The present invention relates to a garbage decomposing apparatus for decomposing garbage such as foodstuff waste materials.

A general garbage decomposing apparatus has a decomposing vessel for accommodating the garbage, a stirrer for stirring the garbage contained in a disposing vessel, a motor for driving the stirrer and an electric heater for heating the garbage in the disposing vessel. The garbage decomposing apparatus causes the garbage to decompose by stirring it and maintaining an appropriate temperature and humidity in the disposing vessel.

The garbage decomposing apparatus is typically disposed at a distance from a kitchen unit at which the garbage is produced, and has an inlet for the garbage which is manually opened and closed. Thus, to input the garbage in the disposing vessel, a user must convey the garbage to the place of the garbage decomposing apparatus, open the cover of the inlet by hand, input garbage and then close the cover, causing the user to suffer from much inconveniences.

Further, since the garbage is input into the disposing vessel usually together with excessive water, a water regulating material such as sawdust must be used to maintain proper water in the disposing vessel. As a result, the amount of the materials to be disposed of increases. Thus, it is desired that the water be separated from the garbage prior to the garbage being input into the disposing vessel.

Moreover, The conventional garbage decomposing apparatus uses an electric heater installed on the inner surface of the disposing vessel to heat the materials contained in the disposing vessel to a proper temperature necessary for decomposing the garbage by microorganisms. Such a heater fails to heat uniformly the garbage in the disposing vessel.

SUMMARY OF THE INVENTION

Therefore, it is an object of the present invention to provide a garbage decomposing apparatus in which an inlet for garbage is automatically opened and closed and water is separated and removed from the garbage during introducing of the garbage into a disposing vessel.

It is another object of the invention to provide a garbage decomposing apparatus capable of uniformly heating the garbage in a disposing vessel.

To accomplish the above objects of the present invention, there is provided a garbage decomposing apparatus for decomposing garbage contained in a disposing vessel, which comprises an inlet channel extending substantially vertically downward from an inlet for the garbage; a leading channel branched off from the inlet channel and leading to the disposing vessel, the leading channel having a garbage opening communicating with the inlet channel for receiving the garbage from the inlet channel; a water drainage channel branched off from the inlet channel upstream of the leading channel, and the water drainage channel having a drainage opening communicating with the inlet channel for receiving the garbage from the inlet channel; a filter disposed in the drainage opening for separating water from the garbage; a shutter installed movably up and down in the inlet channel and having a shutting surface inclined toward the openings; means for supporting the shutter for the up-down movement, the shutter supporting means positioning the shutter under the drainage opening when a load on the shutter is not more than a predetermined value, so that the water in the garbage is allowed to be drained to the water drainage channel through the drainage opening, the shutter supporting means positioning the shutter under the garbage opening when a load on the shutter is more than the predetermined value, so that the garbage is allowed to be introduced to the leading channel through the garbage opening; and means for stirring the garbage in the disposing vessel.

It is preferable that the shutter supporting means comprises a bellows expanding and contracting by air; a compressor for supplying air into the bellows; a sensor for detecting a load on the shutter based on the internal air pressure in the bellows; an introducing detection sensor for sensing the presence of the garbage passing through the leading channel; and a controller for enabling the bellows to be contracted by discharging the internal air out of the bellows when the internal air pressure detected by the load detection sensor is more than a predetermined value to thus enable the garbage on the shutter to be introduced into the leading channel, and controlling the bellows to be expanded by supplying air into the bellows according to a sensed signal of the input detection sensor.

To achieve a uniform heating in the disposing vessel, advantageously, the stirring means comprises a hollow stirring wing formed with a plurality of throughholes and a driving means for rotating the stirring wing, and the garbage disposing apparatus further comprises a heater for heating air and a blower for blowing the air heated by the heater into the stirring wing.

DETAILED DESCRIPTION OF THE PREFERRED EMBODIMENT

A preferred embodiment of the present invention will be described below in more detail with reference to the accompanying drawings.

Figure 1:
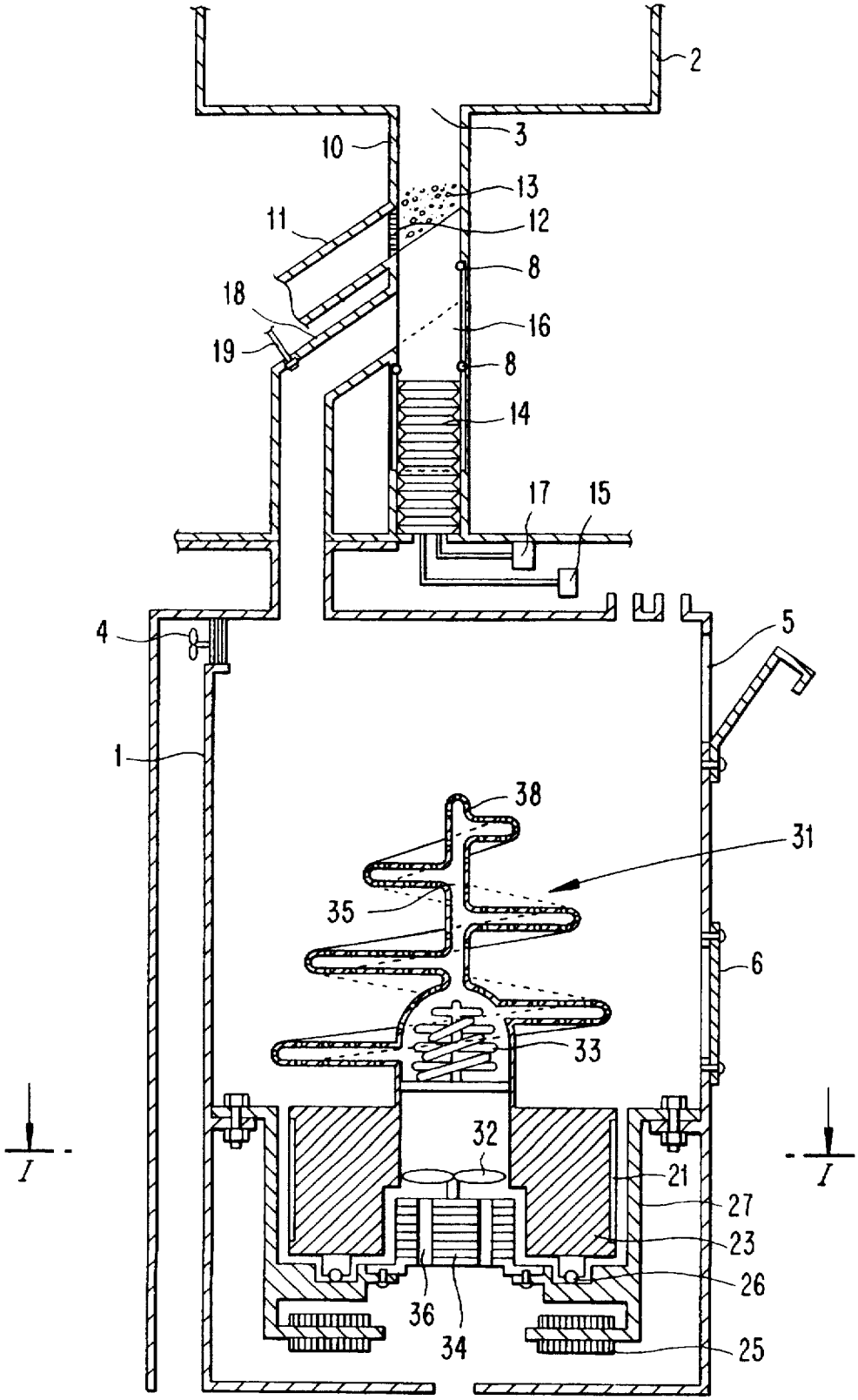
FIG. 1 is a cross-sectional view of a garbage decomposing apparatus according to the present invention.

A garbage decomposing apparatus according to the present invention, as shown in FIG. 1, is generally comprised of a disposing vessel 1 for accommodating garbage to be treated, a inlet unit positioned at the upper side of the disposing vessel 1, a stirrer 31 for stirring the garbage in the disposing vessel 1, and a hot air supplying unit 3.

The inlet unit has an inlet channel 10 extending substantially vertically downward from an inlet opening 3 disposed in for example a sink 2 of a kitchen. Garbage produced in the sink 2 is introduced in the inlet channel 10 through the inlet opening 3. From the inlet channel 10, a water drainage channel 11 and a leading channel 18 are branched off. The water drainage channel 11 is disposed upstream of the leading channel 18 and has a drainage opening communicating with the inlet channel 10 to drain water contained in the garbage introduced in the inlet channel 10. A filter 12 is disposed in the drainage opening of the water drainage channel 11 for separating water from the garbage. The leading channel 18 also has a garbage opening opened toward the inlet channel 10 to receive the garbage.

In the inlet channel 10, a shutter 16 is provided and is movable up and down. The shutter 16 has a upper shutting surface **16*a* supporting the garbage introduced in the inlet channel 10. The shutting surface of the shutter 16 is inclined toward the branched openings of the water drainage channel 11 and the leading channel 18**.

The shutter 16 is supported by means of a bellows 14. The bellows 14 is supplied with pressed air by a compressor 15 to expand and contract it's height according to the internal air pressure. The shutter 16 reciprocates up and down by the expanding and the contracting of the bellows 14 between an upper position just below the drainage opening of the water drainage channel 11 see solid line position of FIG. 1 and a lower position just below the garbage opening of the leading channel 18 see broken line position of FIG. 1. When the shutter 16 is positioned just below the drainage opening of the water drainage channel 11, the garbage 13 input in the inlet channel 10 via the inlet opening 3 is maintained at a state of being supported by the shutter 16, and water contained in the garbage is drained from the garbage 13 into the water drainage channel 11 via the filter 12 installed in the drainage opening, thereby leaving proper moisture in the garbage 13 to be decomposed. When the shutter 16 is positioned just below the garbage opening of the leading channel 18, the garbage 13 is introduced into the leading channel 18, leading to the disposing vessel 1. Balls 8 are installed between the side surface of the shutter 16 and the inner wall of the inlet channel 10, to reduce friction during movement of the shutter 16 upwards and downwards.

An input detection sensor 19 is provided in the leading channel 18 for sensing whether or not the garbage 13 is introduced via the leading channel 18 into the disposing vessel 1.

The bellows 14 has an air pressure sensor 17 for detecting a load, namely an amount of the garbage 13 on the shutter 16 based on the internal air pressure of the bellows 14. The sensed signals detected by the air pressure sensor 17 is provided to a controller (not shown,) such as a microprocessor, which controls the compressor 15 according to the signals from the air pressure sensor 17 to supply or discharge air in the bellows 14. When the internal air pressure of the bellows 14 is higher than a predetermined value, the bellows 14 is contracted by discharging of the air from the bellows 14, so that the garbage 13 on the shutter 16 can be introduced into the leading channel 18.

In an empty state of the inlet channel 10, the expanded bellows 14 locates the shutter 16 at a position just below the drainage opening of the water drainage channel 11. At that state, the garbage 13 is introduced and is deposited on the shutter 16. Water in the garbage 13 is drained from the garbage 13 into the water drainage channel 11 through the filter 12 disposed in the drainage opening of the water drainage channel 11, while the bellows 14 maintains the expansion state by the internal air pressure. If the garbage 13 supported by the shutter 16 weighs more than a predetermined value, the air pressure sensor 17, which senses the air pressure in the bellows 14, generates a corresponding signal to the controller to discharge the internal air from the bellows 14. Accordingly, the shutter 16 is moved down to the position just below the garbage opening of the leading channel 18, thus to enable the garbage 13 to be introduced into the disposing vessel 1 via the leading channel 18.

The garbage 13 passing through the leading channel 18 is detected by the input detection sensor 19. After completion of the passing of the garbage 13 through the leading channel 18, the controller operates the compressor 15 based on a corresponding signal output from the input detection sensor 19 to supply air into the bellows 14 to expand the bellows 14 and move the shutter 16 upward.

The stirrer for stirring the garbage in the disposing vessel 1 has a stirring wing 31 which is installed rotatably about a vertical axis and a driving unit for rotating the stirring wing 31. The stirring wing 31 is formed spirally to improve a stirring effect of the garbage 13 in the disposing vessel 1 during rotation. The stirring wing 31 is hollow to accommodating heating air. A plurality of throughholes 38 are formed on the surfaces of the stirring wing 31 for discharging the heating air from the hollow room 35 of the stirring wing.

The hot air supplying unit comprises a coil heater 33 installed below the stirring wing 31, a blowing air fan 32 for blowing upward toward the coil heater 33 and a fan motor 34 for driving the blowing fan 32. The air heated by the coil heater 33 is supplied to the internal hollow room 35 of the stirring wing 31 by the blower 32 and then discharged into the disposing vessel 1 via the throughholes 38. Accordingly, the garbage 13 in the disposing vessel 1 is heated by the hot air. Vent holes 36 are provided in the fan motor 34 to provide an air channel for supplying the air to the stirring wing 31 via the blowing fan 32.

The driving unit for rotating the stirring wing 31 is installed in the lower portion of the disposing vessel 1. The driving unit includes a rotor 23, to the outer circumferential side surface of which a plurality of permanent magnets 21 are attached, a stator 27 which surrounds the rotor 23 with a circumferential gap, and an exciting coil 25 for supplying a magnetic force to the stator 27. A thrust bearing 26 for supporting the rotation of the rotor 23 is installed under the rotor 23 to reduce friction and noise during rotation of the rotor 23.

Figure 2:
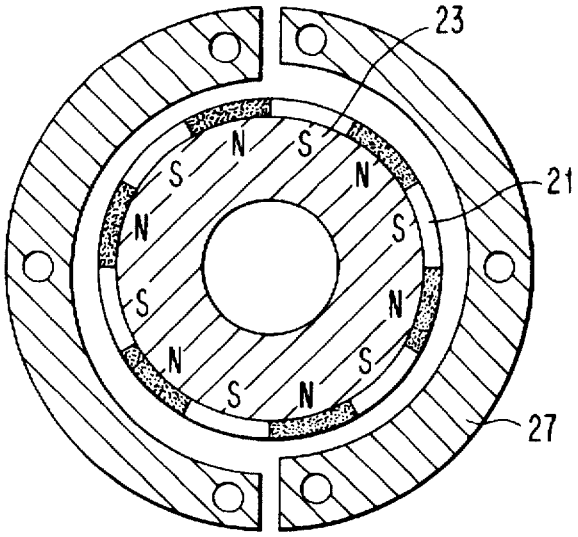
FIG. 2 is a partly cross-sectional view cut along the line 2—2 of FIG. 1.

FIG. 2 is a partly cross-sectional view cut along the line 2—2 of FIG. 1. The N-pole and the S-pole of the permanent magnets 21 attached on the circumferential surface of the rotor 23 are alternately arranged. The stator 27 is formed of two shells, and surrounds almost all the circumferential surface of the rotor 23. The gap between each shell and the rotor 23 increases gradually from the minimum to the maximum. The gaps of the shells are symmetrical with each other to the axis of the rotor 23. If a magnetic force is supplied to the stator 27 by the exciting coil 25, the rotor 23 rotates due to the differences between the magnetic forces due to the differences of the distance between the rotor 23 and each of the shells of the stator 27.

Another inlet opening 5 is disposed on the upper portion of a side wall of the disposing vessel 1 and a discharging outlet 6 is disposed on the lower side thereof. Accordingly, the input opening 5 and the discharging outlet 6 are used for manually inputting and discharging the garbage, respectively. A blower 4 is installed in the upper portion of the disposing vessel 1 to discharge a gas out of the disposing vessel 1 to the outside.

As described above, the garbage decomposing apparatus according to the present invention enables the inlet channel to be automatically opened and closed and water in garbage to be separated from the garbage.

What is claimed is:

1. A garbage decomposing apparatus comprising:

a vessel having a stirrer for stirring garbage therein;

a heater for heating garbage in the vessel;

an inlet channel extending downwardly and communicating with the vessel;

a water drainage channel communicating with the inlet channel for conducting away water separated from the garbage;

a garbage supporting mechanism movable in the inlet channel between a first position locating the garbage adjacent the water drainage channel to allow water in the garbage to flow into the water drainage channel, and a second position allowing the garbage to flow into the vessel; and a moving mechanism for moving the garbage supporting mechanism between the first and second positions.

2. The apparatus according to claim 1 further including a filter separating the garbage from the water drainage channel when the garbage supporting mechanism is in the first position for preventing garbage from flowing into the water drainage channel.

3. The apparatus according to claim 2 wherein the filter is connected fixedly at an inlet to the water drainage channel.

4. The apparatus according to claim 1 wherein the water drainage channel is inclined downwardly from a portion of the inlet channel; the inlet channel including a downwardly inclined leading channel disposed below the water drainage channel; the garbage supporting mechanism including a support member movably vertically in the inlet channel between the first and second positions, the support member including a downwardly inclined upper surface which is aligned with the water drainage channel when the support member has been lowered from its first position to its second position, to enable garbage to gravitate into the leading channel.

5. The apparatus according to claim 4 wherein the moving mechanism is responsive to a weight of garbage on the supporting surface to move the support member from its first position to its second position when the weight of garbage exceeds a reference weight.

6. The apparatus according to claim 4 wherein the moving mechanism includes a bellows disposed beneath the support member; a compressor for supplying air to the bellows for expanding the bellows to move the support member to its first position, a sensor for detecting a load acting on the support surface, and a controller connected to the sensor and compressor for actuating the compressor to expand the bellows when garbage on the supporting surface exceeds the reference value.

7. The apparatus according to claim 6 further including a detector for sensing the travel of garbage through the leading channel.

8. The apparatus according to claim 1 wherein the stirrer comprises a hollow stirring wing rotatable about an axis; the stirring wing including a plurality of air outlet holes, the heater arranged for heating air, a conduit communicating the heater with the interior of the hollow stirring wing, and a blower; the blower arranged for forcing heated air from the heater, through the hollow stirring wing, and outwardly through the air outlet holes to heat the garbage.

9. The apparatus according to claim 8 wherein the hollow stirring wing is of spiral shape.

10. The apparatus according to claim 1 further including a sink having a bottom wall, the inlet channel communicating with the sink through the bottom wall for receiving garbage.

* * * * *